US007177586B2

(12) United States Patent
Yoshizuka

(10) Patent No.: US 7,177,586 B2
(45) **Date of Patent: *Feb. 13, 2007**

(54) APPARATUS AND METHOD OF FORMING IMAGE USING ROTARY DEVELOPER

(75) Inventor: Ken Yoshizuka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/058,247

(22) Filed: Feb. 16, 2005

(65) Prior Publication Data

US 2005/0141938 A1 Jun. 30, 2005

Related U.S. Application Data

(63) Continuation of application No. 10/460,671, filed on Jun. 13, 2003, now Pat. No. 6,931,229.

(51) Int. Cl.
*G03G 15/00* (2006.01)

(52) U.S. Cl. ..... 399/394

(58) Field of Classification Search ..... 399/394
See application file for complete search history.

(56) References Cited

U.S. PATENT DOCUMENTS

| | | | | |
|---|---|---|---|---|
| 4,310,153 | A * | 1/1982 | Kikuchi | 271/259 |
| 5,893,022 | A | 4/1999 | Yoshino et al. | |
| 6,516,179 | B1 * | 2/2003 | Sawai et al. | 399/388 |
| 6,813,471 | B2 * | 11/2004 | Sawai et al. | 399/388 |

FOREIGN PATENT DOCUMENTS

| | | | |
|---|---|---|---|
| JP | 57-192968 | | 11/1982 |
| JP | 08076590 | A * | 3/1996 |
| JP | 2000231232 | A * | 8/2000 |
| JP | 2002193486 | A * | 7/2002 |
| JP | 2002268402 | A * | 9/2002 |

* cited by examiner

*Primary Examiner*—Quana Grainger
(74) *Attorney, Agent, or Firm*—Sughrue Mion, PLLC

(57) ABSTRACT

A CPU drives a transportation system driving motor and turns on a paper feed clutch after an exposure unit starts forming an electrostatic latent image on a photosensitive member of a photosensitive member unit, whereby a paper feed roller is driven into rotations and feeding of a transfer paper onto a transfer paper transportation path is started.

4 Claims, 5 Drawing Sheets

STAND-BY POSITION

DEVELOPING POSITION

UNLOADING POSITION

APPARATUS AND METHOD OF FORMING IMAGE USING ROTARY DEVELOPER

This is a continuation of application Ser. No. 10/460,671 filed Jun. 13, 2003 now U.S. Pat. No. 6,931,229, which is incorporated herein by reference.

BACKGROUND OF THE INVENTION

1. Field of the Invention

The present invention relates to an image forming technique utilizing electrophotography for a printer, a copier machine, a facsimile machine, etc.

2. Description of the Related Art

Among conventional image forming apparatuses utilizing electrophotography is an apparatus in which exposure means forms an electrostatic latent image in each one of a plurality of colors on a photosensitive member, developing means makes toner of the respective colors adhering to the electrostatic latent images, the toner images in the respective colors are each primarily transferred onto an intermediate transfer medium to thereby form a color toner image, which is the toner images in the plurality of colors superimposed one atop the other, on the intermediate transfer medium, and thus formed color toner image is secondarily transferred from the intermediate transfer medium onto a transfer paper at a secondary transfer position which is on the intermediate transfer medium, whereby a color image is obtained.

Known as an image forming apparatus which is of this type and aims at size reduction of a main apparatus section is one that a rotary developer, which comprises a plurality of developer units housing toner in mutually different colors and located in a radial arrangement about a rotation shaft, is driven into rotations about the rotation shaft, one of the plurality of developer units is positioned facing a photosensitive member, an electrostatic latent image on the photosensitive member is accordingly developed with toner, and the toner image is then primarily transferred onto an intermediate transfer medium. In this image forming apparatus, the rotary developer is driven into rotations to thereby switch the developer unit which is to be positioned at a developing position, and development using toner in each color and primary transfer is repeated, so that toner images in the plurality of colors are superimposed one atop the other on the intermediate transfer medium and a color toner image is formed.

A sequence of operations used in an image forming apparatus utilizing electrophotography is, in general, to detect whether there is a transfer paper or not within a transfer paper housing at the transfer paper feed timing, feed the transfer paper which is housed in the transfer paper housing to a transfer paper transportation path when there is a transfer paper, and start an image forming operation (an exposing operation for forming an electrostatic latent image for instance) at predetermined timing after the start of paper feeding. In addition, an apparatus structure is used that on the transfer paper transportation path, there is secondary paper feeding means which is formed by paired registration rollers for instance and performs secondary paper feeding to a secondary transfer position at the timing synchronized to an operation of forming a primary toner image on an intermediate transfer medium. In such an image forming apparatus, a transfer paper fed to the transfer paper transportation path is temporarily held in a bent state by the paired registration rollers which are disposed on the transfer paper transportation path. The front edge of the transfer paper is straightened and securely nipped between the paired registration rollers by the bending force, which prevents a skew and allows preferable secondary paper feeding from the paired registration rollers without deviating from the timing.

A reduction in footprint of an image forming apparatus is desired these days, and therefore, a structure in a popular use is that a transfer paper housing is disposed in a lower part of a main apparatus section, an intermediate transfer medium is disposed above the transfer paper housing, and a transfer paper is transported along a transfer paper transportation path which runs approximately in the vertical direction from the transfer paper housing toward a secondary transfer position. However, in an image forming apparatus having such a structure, since the length of the path from the transfer paper housing to paired registration rollers is short, a time required for a transfer paper to arrive at the paired registration rollers from the start of paper feeding is short and a time that the paired registration rollers hold the transfer paper in a bent state becomes too long in the conventional control sequence as described above, and hence, the transfer paper may be deformed and it may accordingly become impossible to obtain a high-quality transfer image.

SUMMARY OF THE INVENTION

An object of the invention is to provide an image forming apparatus and an image forming method which shorten a time that secondary paper feeding means holds a transfer paper in a bent state to thereby secure a high-quality transfer image.

The present invention is directed to an image forming apparatus, comprising: a photosensitive member; exposure means which forms an electrostatic latent image on the photosensitive member; developing means, including a plurality of developer units and a holder which holds the plurality of developer units and rotates about a predetermined rotation shaft, in which one of the plurality of developer units is selectively positioned facing the photosensitive member so that this developer unit makes toner adhering to the electrostatic latent image and accordingly develops the electrostatic latent image; an intermediate transfer medium which transports a toner image primarily transferred from the photosensitive member to a predetermined secondary transfer position while carrying the primarily transferred toner image; a transfer paper housing which is disposed below the secondary transfer position and house at least one transfer paper; paper feeding means which feeds a transfer paper from the transfer paper housing to a transfer paper transportation path which runs approximately in the vertical direction and guides a transfer paper to the secondary transfer position from the transfer paper housing; secondary paper feeding means which is disposed on the transfer paper transportation path, and which secondarily feeds, in synchronization to primary transfer of a toner image onto the intermediate transfer medium from the photosensitive member, a transfer paper fed from the transfer paper housing toward the secondary transfer position after temporarily holding the transfer paper in a bent state; and paper feeding control means which makes the paper feeding means start feeding a transfer paper after the exposure means starts an electrostatic latent image forming operation.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
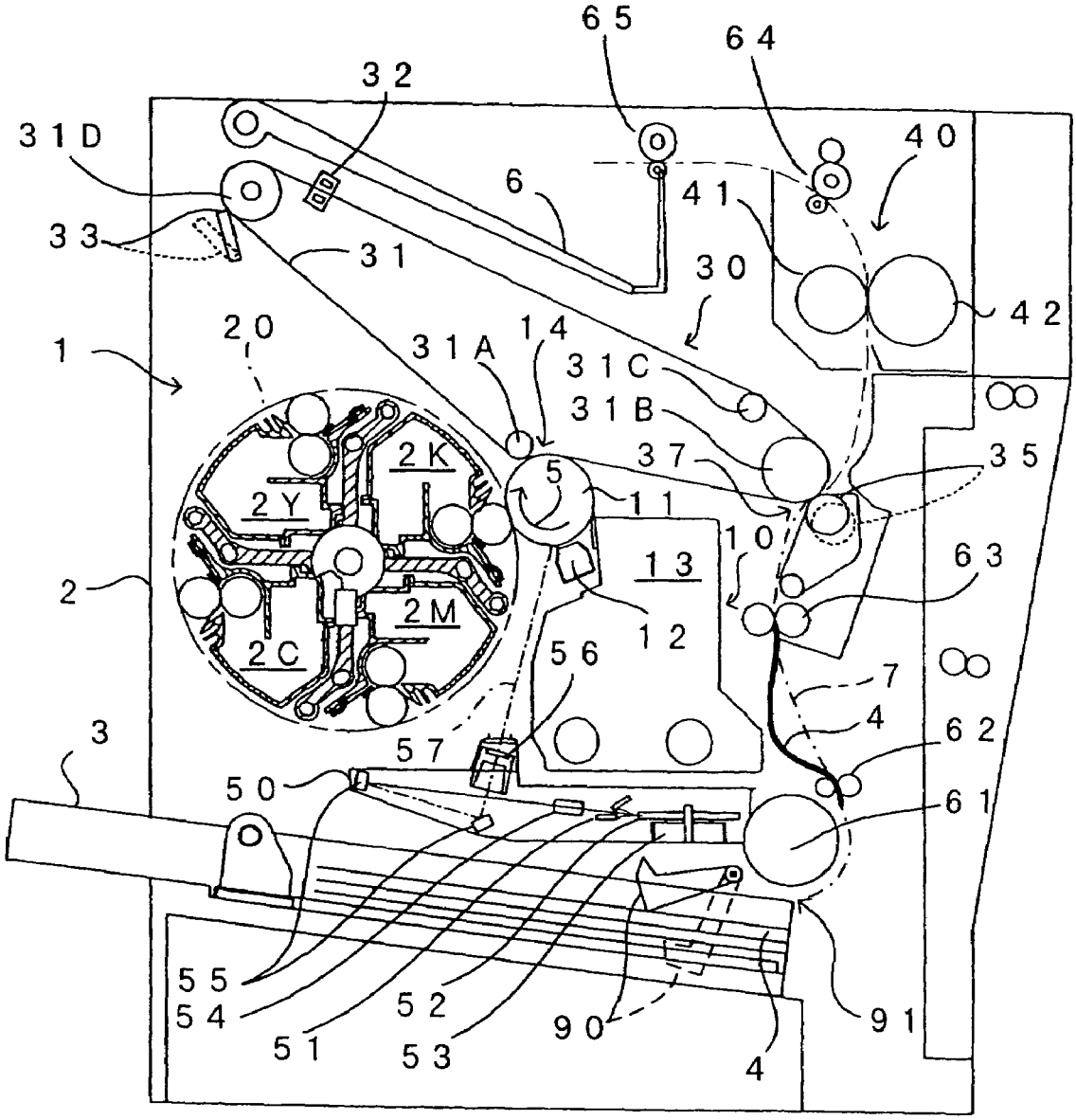
FIG. 1 is a drawing which shows the internal structure of the printer which is one preferred embodiment of the image forming apparatus of the present invention.
Figure 2A:
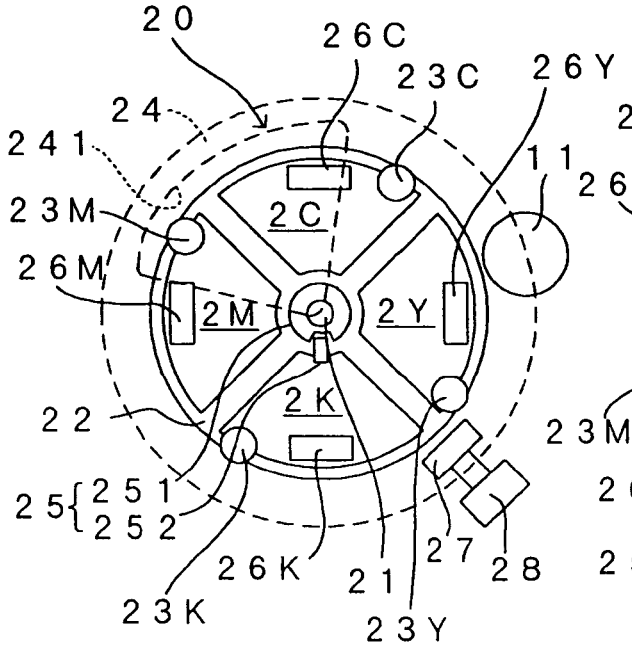
FIGS. 2A, 2B and 2C are schematic diagrams of the rotary developer.
Figure 2B:
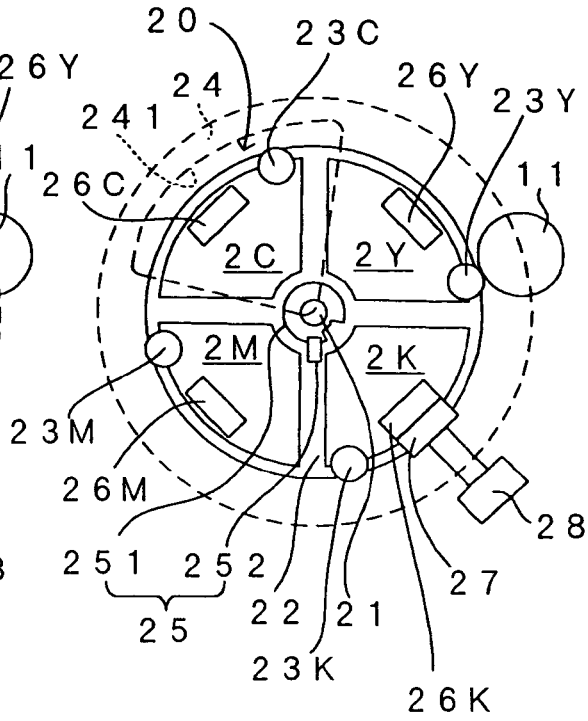
Figure 2C:
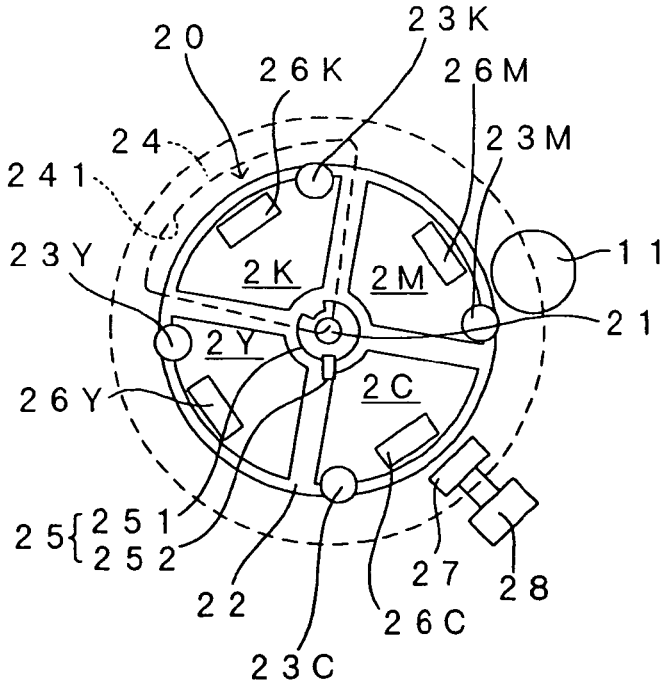
Figure 3A:
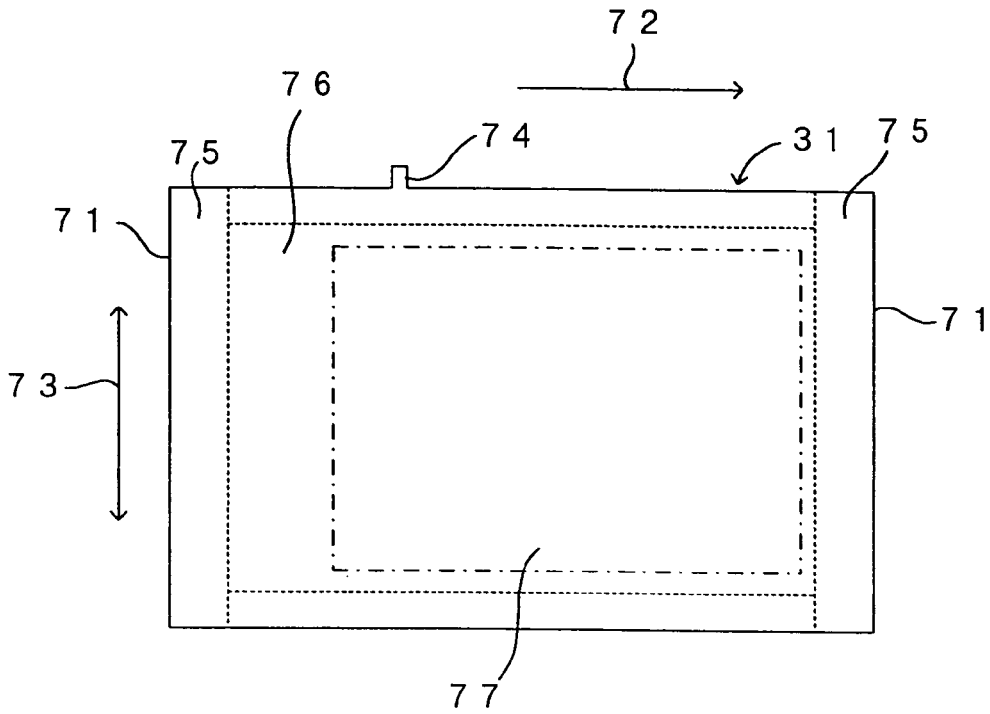
FIGS. 3A and 3B are development views of the intermediate transfer belt.
Figure 3B:
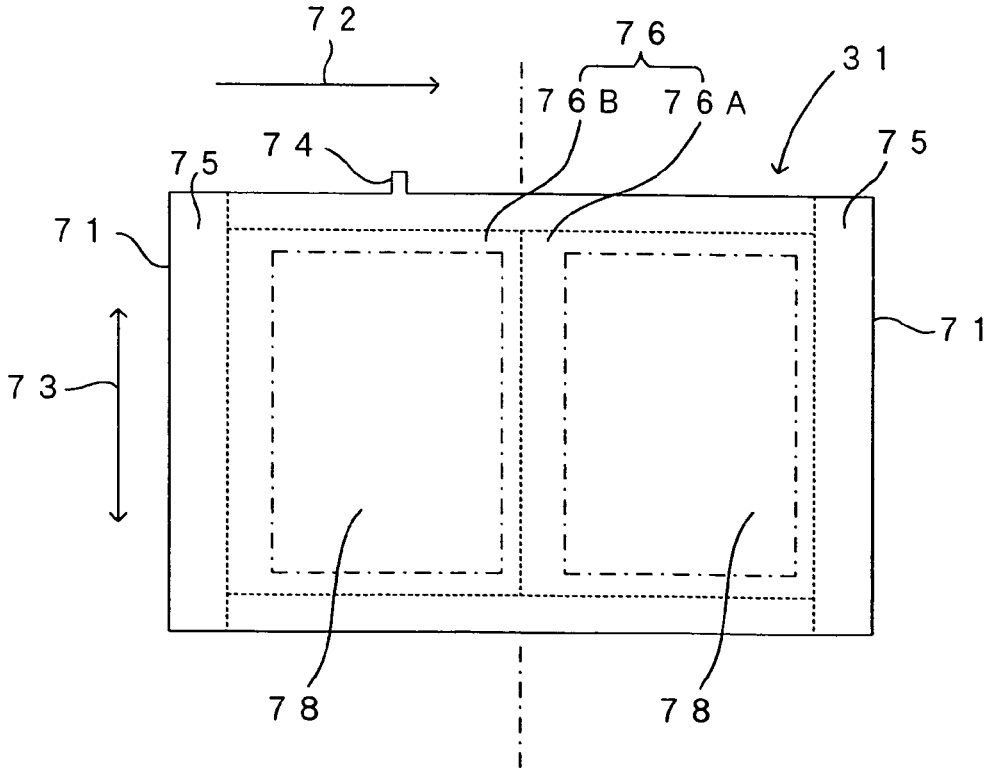
Figure 4:
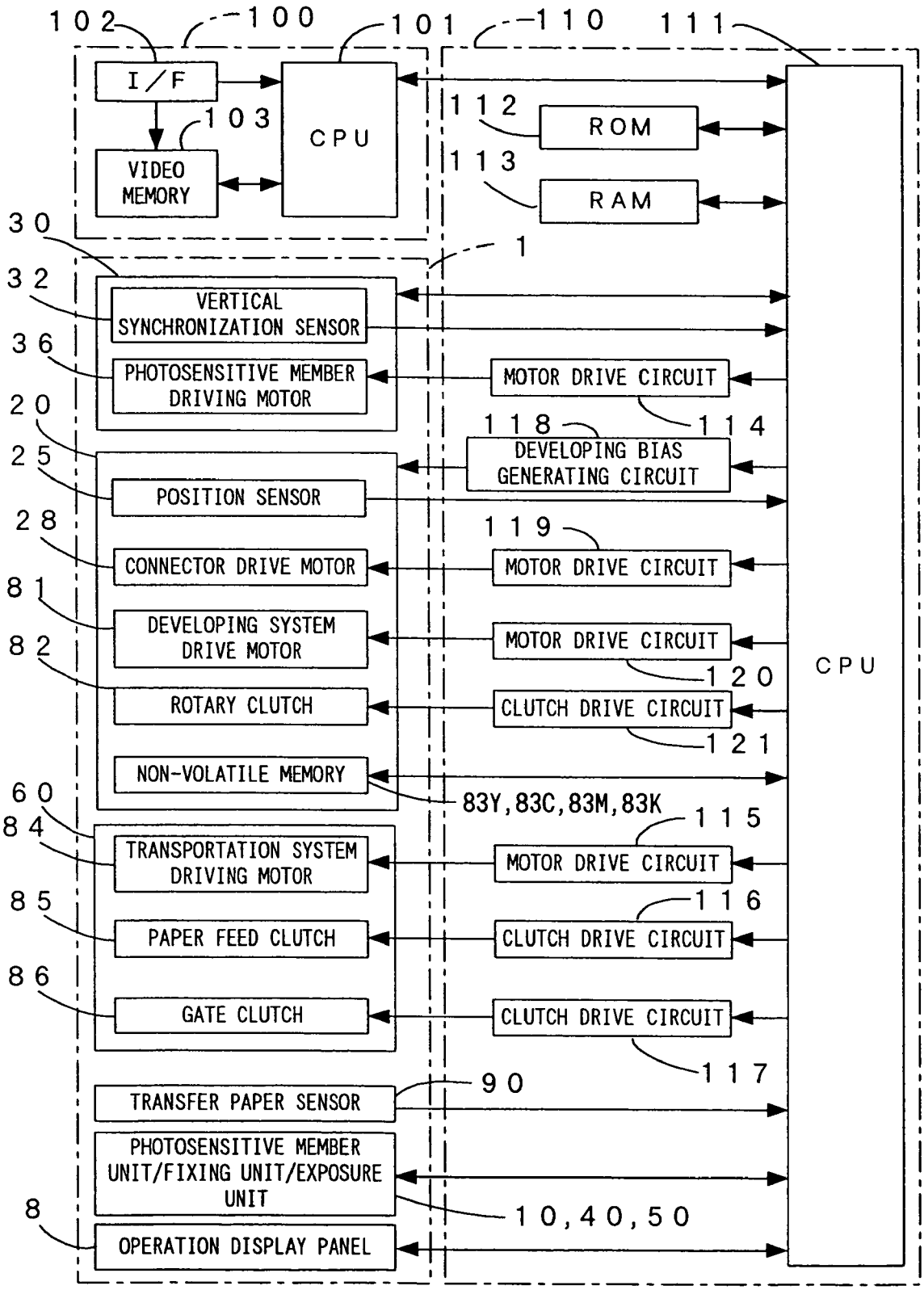
FIG. 4 is a block diagram which shows the electric structure of the printer.

First, a description will be given on a structure of a printer which is a preferred embodiment of an image forming apparatus of the present invention, with reference to FIGS. 1 through 4. FIG. 1 is a drawing which shows an internal structure of the printer, FIGS. 2A, 2B and 2C are schematic diagrams of the rotary developer, FIGS. 3A and 3B are development views of the intermediate transfer belt, and FIG. 4 is a block diagram which shows an electric structure of the printer.

This printer is for superimposing toner in four colors which are yellow (Y), magenta (M), cyan (C) and black (K) and thereby forming a full color image, or for forming a monochrome image using only toner in the black color (K) for instance. In this printer, when a print instruction signal containing a video signal is fed to a main controller 100 from an external apparatus such as a host computer, an engine controller 110 controls each portion of an engine part 1 in accordance with a control signal from the main controller 100, and the printer prints out an image corresponding to the video signal on a transfer paper 4 transported from a paper feeding cassette 3 which is disposed in a lower section of a main apparatus section 2.

In addition to the paper feeding cassette 3 described above, the engine part 1 comprises a photosensitive member unit 10, a rotary developer 20, an intermediate transfer unit 30, a fixing unit 40 and an exposure unit 50, which are disposed above the paper feeding cassette 3. The photosensitive member unit 10 comprises a photosensitive member 11, an electrifier 12 and a cleaner 13. The rotary developer 20 comprises a yellow developer unit 2Y housing yellow toner, a magenta developer unit 2M housing magenta toner, a cyan developer unit 2C housing cyan toner, a black developer unit 2K housing black toner, etc. The intermediate transfer unit 30 comprises an intermediate transfer belt 31, a vertical synchronization sensor 32, a belt cleaner 33, a secondary transfer roller 35, a photosensitive member driving motor 36, etc. These seven units 10, 2Y, 2C, 2M, 2K, 30 and 40 are formed so that these units can be freely attached to and detached from the main apparatus section 2.

With the seven units 10, 2Y, 2C, 2M, 2K, 30 and 40 described above mounted to the main apparatus section 2, the photosensitive member 11 of the photosensitive member unit 10 is rotated by the photosensitive member driving motor 36 in the direction of an arrow 5, and abuts on the intermediate transfer belt 31. This abutting position is set up in a primary transfer part 14. Along the rotating direction 5 of the photosensitive member 11, the electrifier 12, the rotary developer 20 and the cleaner 13 are disposed around the photosensitive member 11.

The electrifier 12 comprises a wire electrode to which a predetermined high voltage is applied. Utilizing corona discharge for instance, the electrifier 12 uniformly electrifies an outer circumferential surface of the photosensitive member 11, thus functioning as electrifying means. The cleaner 13 is disposed on the immediate upstream side to the electrifier 12 and the downstream side to the primary transfer part 14 in the rotating direction 5 of the photosensitive member 11. The cleaner 13 scrapes off, by means of a cleaning blade, toner which remains on the outer circumferential surface of the photosensitive member 11 after primary transfer of a toner image onto the intermediate transfer belt 31 from the photosensitive member 11, to thereby clean the surface of the photosensitive member 11.

The exposure unit 50 comprises a laser light source 51 which is formed by a semiconductor laser for instance, a polygon mirror 52 which reflects laser light from the laser light source 51, a polygon motor 53 which drives the polygon mirror 52 into rotations, a lens part 54 which converges the laser light reflected by the polygon mirror 52, a plurality of reflection mirrors 55, a horizontal synchronization sensor 56, etc. Leaving the lens part 54 and the reflection mirrors 55 after reflected by the polygon mirror 52, laser light 57 scans the surface of the photosensitive member 11 in a main scanning direction (a direction which is perpendicular to the plane of FIG. 1), whereby an electrostatic latent image corresponding to the video signal is formed on the surface of the photosensitive member 11. At this stage, the horizontal synchronization sensor 56 provides a synchronizing signal which is in the main scanning direction, i.e., a horizontal synchronizing signal.

The polygon motor 53 is for driving the polygon mirror 52 so that the polygon mirror 52 rotates at a high speed of a predetermined rotating speed which is 30,000 rpm (revolutions per minute) for instance, and has a structure which permits high speed rotations using an oil bearing for instance. When the rotating speed reaches the set rotating speed mentioned above from the start of driving, the polygon motor 53 sends a ready signal to a CPU 111. The exposure unit 50 corresponds to exposure means.

The rotary developer 20 comprises a holder frame 22 which is fixed to a rotation shaft 21 of the rotary developer 20. The holder frame 22 holds the four-color developer units 2Y, 2C, 2M and 2K in such a manner that the developer units are freely attached and detached. The developer units 2Y, 2C, 2M and 2K respectively comprise developer rollers 23Y, 23C, 23M and 23K. With each one of the developer rollers 23Y, 23C, 23M and 23K positioned at a developing position which abuts on the photosensitive member 11 (that is, positioned facing the photosensitive member 11), the toner in each corresponding color adheres to the electrostatic latent image on the photosensitive member 11 and the image is developed.

As denoted at the dotted line in FIG. 2, a side plate 24 is disposed to the main apparatus section 2 which is located in front of the rotary developer 20 along a direction perpendicular to the plane of FIG. 1. The side plate 24 comprises an unloading slot 241 which is bored at an appropriate position. Although the side plate 24 is circular in FIG. 2 for convenience of description, this is not limiting. Instead, the side plate 24 may have other shape which covers the entire side surface of the main apparatus section 2 for example.

Guide rails (not shown) which engage with each other are disposed to the respective developer units 2Y, 2C, 2M and 2K and the holder frame 22, in such a manner that the guide rails are parallel to the rotation shaft 21. Each one of the developer units 2Y, 2C, 2M and 2K can be pulled out through the unloading slot 241 along the direction of the rotation shaft 21 of the holder frame 22. Further, as a new developer unit is pushed in through the unloading slot 241 along the direction of the rotation shaft 21 of the holder frame 22, the new developer unit is mounted to the holder frame 22.

As shown in FIG. 2C for instance, only when one of the developer units (which is the developer unit 2K in this example) is positioned to an unloading position, it is possible to unload this developer unit through the unloading slot 241 and mount a new developer unit after unloading. While the developer unit is located other than at the unloading position, unloading of the developer unit is blocked by the side plate 24. As the developer units 2Y, 2C, 2M and 2K are all mounted to the holder frame 22, the respective developer units 2Y, 2C, 2M and 2K are positioned in a radial arrangement around the rotation shaft 21.

A developing system drive motor 81 is connected to the rotation shaft 21 through a rotary clutch 82. The developing system drive motor 81 is formed by a stepping motor for instance in the preferred embodiment. In addition to the rotation shaft 21, the developing system drive motor 81 is connected also to the developer rollers 23Y, 23C, 23M and 23K. As the developing system drive motor 81 is driven into forward rotations in response to turning on of the rotary clutch 82, the holder frame 22 rotates and the positions of the four developer units 2Y, 2C, 2M and 2K move accordingly. On the other hand, in a condition that one developer unit is positioned at the developing position, as the developing system drive motor 81 is driven into backward rotations in response to turning off of the rotary clutch 82, the developer rollers 23Y, 23C, 23M and 23K rotate. In FIGS. 1 and 2, the holder frame 22 rotates clockwise and the developer rollers 23Y, 23C, 23M and 23K rotate counterclockwise for instance in the preferred embodiment.

There is a position sensor 25, which detects a stand-by position (home position) of the holder frame 22 (the rotary developer 20), disposed to one edge side (the forward side relative to the plane of FIG. 2 for example) to the rotation shaft 21. The position sensor 25 comprises a detection disk 251 which is fixed to the rotation shaft 21 and a photo-interrupter 252 which is formed by a light emitter (such as an LED) and a light receiver (such as a photo diode). The position sensor 25 is disposed such that a fringe portion of the detection disk 251 rotates in a gap between the light emitter and the light receiver of the photo-interrupter 252.

In this structure, when a slit formed at the fringe portion of the detection disk 251 passes through the gap in the photo-interrupter 252, an output signal from the photo-interrupter 252 switches between a low level and a high level. The developing system drive motor 81 stops after driving over the predetermined number of drive pulses from the level change of the output signal, whereby the rotary developer 20 is stopped at the stand-by position. With respect to rotations from the stand-by position, the position of the holder frame 22 is judged based on the number of drive pulses of the developing system drive motor 81 from the point at which the level of the output signal from the position sensor 25 changed. FIG. 1 shows a state that the black developer unit 2K is positioned at the developing position, FIG. 2A shows a state that the holder frame 22 is positioned at the stand-by position, FIG. 2B shows a state that the yellow developer unit 2Y is positioned at the developing position, and FIG. 2C shows a state that the black developer unit 2K is positioned at the unloading position.

The structure of the position sensor 25 is not limited to this but may use a reflection-type optical sensor instead of a photo-interrupter. Alternatively, a characteristic portion such as a projection may be formed locally in an outer fringe of the holder frame 22 so that detection of the characteristic portion realizes detection of the stand-by position, for instance. In this case, it is not necessary to dispose the detection disk 251 to the rotation shaft 21 and the size along the axial direction is reduced, which is advantageous for size reduction of the apparatus.

Unit-side connectors 26Y, 26C, 26M and 26K are fixed respectively to one edge side surfaces of the developer units 2Y, 2C, 2M and 2K, and a main-side connector 27 is disposed for free movements to the main apparatus section 2. As the holder frame 22 (the rotary developer 20) is positioned at the developing position, the unit-side connector fixed to the next developer unit which is on the downstream side along the rotation direction of the holder frame 22 of the developer unit which is at the developing position (e.g., the unit-side connector 26K fixed to the black developer unit 2K which is the next developer unit on the downstream side, when the yellow developer unit 2Y is positioned at the developing position, as shown in FIG. 2B) becomes faced with the main-side connector 27.

The unit-side connectors 26Y, 26C, 26M and 26K respectively incorporate non-volatile memories 83Y, 83C, 83M and 83K (FIG. 4). The non-volatile memories 83Y, 83C, 83M and 83K are for storing various types of data regarding the respective developer units 2Y, 2C, 2M and 2K, and are respectively connected to terminal electrodes (not shown) of the unit-side connectors 26Y, 26C, 26M and 26K. As the non-volatile memories, EEPROMs such as flash memories, ferroelectric memories (ferroelectric RAMs) or the like may be used.

A connector drive motor 28 is for moving the main-side connector 27 along a contacting/clearing direction relative to the rotary developer 20. The connector drive motor 28 moves the main-side connector 27 between an engaging position for engaging with and a disengaging position for disengaging from the unit-side connector (the unit-side connector 26K in FIG. 2B) which is disposed facing the main-side connector 27.

The terminal electrode of the unit-side connector 26K and the terminal electrode of the main-side connector 27 are electrically connected at the engaging position mentioned above, which electrically connects the non-volatile memory built within this unit-side connector with the CPU 111 via the both connectors. As data are transferred with the CPU 111, mounting of the developer unit is detected, a new unit is detected, the lifetime is managed, etc.

Further, the main apparatus section 2 comprises a front cover which covers the engine part 1 including the respective units 10, 2Y, 2C, 2M, 2K, 30 and 40. To replace the developer unit, a user or the like opens the front cover and does necessary work. Normal printing however is executed with this front cover closed.

A developing bias generating circuit 118 applies a developing bias, which is a direct current component as it is alone or as it is with an alternating current component superimposed, upon the developer roller. This makes the toner in the corresponding color adhere to the electrostatic latent image on the surface of the photosensitive member 11 from the developer unit positioned at the abutting position (the developing position) relative to the photosensitive member 11, and the electrostatic latent image is accordingly developed.

The rotary developer 20 (the developer units 2Y, 2C, 2M and 2K) corresponds to developing means, while the holder frame 22 corresponds to a holder. Meanwhile, the developing system drive motor 81 has a function as unit driving means.

The intermediate transfer belt 31 of the intermediate transfer unit 30 stretches across a tension roller 31A, a drive roller 31B, a tension roller 31C and a follower roller 31D, and corresponds to an intermediate transfer medium. The tension roller 31A is for making the intermediate transfer belt 31 securely abut on the photosensitive member 11. The drive roller 31B is driven into rotations together with the photosensitive member 11 by the photosensitive member driving motor 36.

The intermediate transfer belt 31 is, as shown in FIG. 3, formed by an endless belt which is obtained by joining an approximately rectangular sheet at a splice 71. In FIG. 3, an arrow 72 denotes a direction of rotational driving, while an arrow 73 denotes a rotation shaft direction.

The intermediate transfer belt 31 comprises a projection 74 which is disposed on one edge side (the top side in FIG. 3) to the rotation shaft direction 73, a transfer protection area 75 and a transfer area 76. The transfer protection area 75 is defined across one edge and the other edge along the rotation shaft direction 73 and within a predetermined range which stretches on the both sides to the splice 71. The transfer area 76 is an area other than the transfer protection area 75, and expands in a rectangular area except for a one edge portion and other edge portion along the rotation shaft direction 73. A toner image is primarily transferred in the transfer area 76.

As shown in FIG. 3A, it is possible to transfer within the transfer area 76 a toner image 77 having the A3 size whose longer sides are aligned along the direction of rotational driving 72. Meanwhile, as shown in FIG. 3B, with the transfer area 76 split into two sub areas 76A and 76B, as the intermediate transfer belt 31 rotates one round, it is possible to transfer two toner images each having the A4 size or a smaller size, such as A4, A5 and B5, whose shorter sides are aligned along the direction of rotational driving 72. Shown in FIG. 3B is a toner image 78 of the A4 size.

A bias applying member (not shown) which is shaped like a roller for instance abuts on the intermediate transfer belt 31, and a predetermined primary transfer bias is applied upon the bias applying member. Owing to the primary transfer bias, the toner image on the photosensitive member 11 is primarily transferred onto the intermediate transfer belt 31.

The vertical synchronization sensor 32 is formed by a photo-interrupter which comprises a light emitter (such as an LED) and a light receiver (such as a photo diode) for instance which are disposed facing each other. The vertical synchronization sensor 32 is disposed on one edge side to the rotating intermediate transfer belt 31 along the rotation shaft direction 73, detects passage of the projection 74 and outputs a detect signal. The detect signal outputted from the vertical synchronization sensor 32 is used as a vertical synchronization signal which serves as a reference for image formation control performed by the engine controller 110. The vertical synchronization sensor 32 is disposed in the vicinity of the follower roller 31D, which reduces an influence of bending, swinging and the like of the intermediate transfer belt 31 and allows to stably detect the projection 74.

The belt cleaner 33 is disposed so as to be switched by a contacting/clearing clutch for cleaner between an abutting state (denoted by the solid line in FIG. 1) abutting on the intermediate transfer belt 31 and a cleared-off state (denoted by the dotted line in FIG. 1). In the abutting state, the belt cleaner 33 scrapes off toner which remains on the intermediate transfer belt 31. The belt cleaner 33 abuts on and moves cleared off from the intermediate transfer belt 31 within the transfer protection area 75.

A contacting/clearing clutch for secondary transfer roller switches the secondary transfer roller 35 between an abutting state (denoted by the solid line in FIG. 1) abutting on the intermediate transfer belt 31 and a cleared-off state (denoted by the dotted line in FIG. 1). When applied with a predetermined secondary transfer bias in the abutting state abutting on the intermediate transfer belt 31, the secondary transfer roller 35 secondarily transfers a toner image currently on the intermediate transfer belt 31 onto the transfer paper 4 while transporting the transfer paper 4. The abutting position is located in a secondary transfer part (secondary transfer position) 37.

The fixing unit 40 comprises a heating roller 41 and a pressure roller 42. While transporting the transfer paper 4 with the rollers 41 and 42, the toner on the transfer paper 4 is heated up, melted and accordingly fixed on the transfer paper 4. The fixing unit 40 thus has a function as fixing means.

A transfer paper sensor 90 for detecting whether there is a transfer paper 4 is disposed at an appropriate position inside the paper feeding cassette 3. The transfer paper sensor 90 is formed by a revolving piece and a photo-interrupter which detects the revolving piece. The transfer paper sensor 90 sends a detect signal to the engine controller 110. The detect signal is an ON signal when the revolving piece is positioned by a stack of the transfer papers 4 at a revolved position (denoted by the solid line in FIG. 1), but is an OFF signal when the revolving piece is located at a downward position due to the absence of the transfer paper 4 (denoted by the dotted line in FIG. 1).

A paper feed roller 61 is disposed to the front edge (the right-most edge in FIG. 1) of the paper feeding cassette 3. Above the paper feed roller 61, paired feed rollers 62 and paired gate rollers 63 are disposed. Further, paired transportation rollers 64 and paired discharge rollers 65 are disposed on the other side of the secondary transfer part 37 and the fixing unit 40.

The paper feed roller 61, the paired feed rollers 62, the paired gate rollers 63, the secondary transfer roller 35, the heating roller 41 of the fixing unit 40, the paired transportation rollers 64 and the paired discharge rollers 65 are linked to the same transportation system drive motor 84 each via a drive force transmission mechanism. The transportation system driving motor 84 outputs a ready signal when reaching a predetermined rotating speed. The drive force from the transportation system driving motor 84 is transmitted to the paper feed roller 61 as a paper feed clutch 85 turns on and accordingly rotates, to the paired feed rollers 62 as a feed clutch (not shown) turns on and accordingly rotates, but to the paired gate rollers 63 as a gate clutch 86 turns on and accordingly rotates. The paired discharge rollers 65 discharge the transfer paper 4 to a discharging part 6 which is disposed in an upper portion of the main apparatus section 2.

The position at which the paper feed roller 61 is disposed in the paper feeding cassette 3 is set at a paper feed position 91. A transfer paper transportation path 7 (denoted by the dashed-and-dotted line in FIG. 1) runs approximately in the vertical direction from the paper feed position 91 to the secondary transfer part 37. There are the paired feed rollers 62 and the paired gate rollers 63 on the transfer paper transportation path 7. As described above, the transfer paper transportation path 7 functions as a transportation path which guides the transfer paper 4 from the paper feeding cassette 3 to the secondary transfer position. In short, when the transfer paper 4 is fed from the paper feeding cassette 3 to the transfer paper transportation path 7 by the paper feed roller 61, the transfer paper 4 is transported along the transfer paper transportation path 7.

The paired feed rollers 62, the paired gate rollers 63, the paired transportation rollers 64, the paired discharge rollers 65, the transportation system driving motor 84, the paper feed clutch 85, the feed clutch, the gate clutch 86 and the like form a transfer paper transporting part 60.

The paper feeding cassette 3 corresponds to a transfer paper housing, the paper feed roller 61 corresponds to paper feeding means, and the paired gate rollers 63 correspond to secondary paper feeding means.

In FIG. 4, an operation display panel 8 is disposed to the top surface of the main apparatus section 2 at an appropriate position, and comprises a plurality of operation keys and a display part formed by a liquid crystal display for instance. The main controller 100 comprises a CPU 101, an interface 102 which transfers a control signal with an external apparatus, and a video memory 103 which stores a video signal which is fed through the interface 102. Receiving a print instruction signal containing a video signal from an external apparatus via the interface 102, the CPU 101 converts the signal into job data which are in a format appropriate to provide the engine part 1 with an instruction for operation, and sends the data to the engine controller 110.

The engine controller 110 comprises the CPU 111, a ROM 112, a RAM 113, etc. The ROM 112 stores a control program of the CPU 111, etc. The RAM 113 temporarily stores control data of the engine part 1, a result of computation by the CPU 111, etc. The CPU 111 causes data regarding the video signal sent from the external apparatus through the CPU 101 to be stored in the RAM 113.

As input signals from the engine part 1, the CPU 111 receives a vertical synchronizing signal Vsync from the vertical synchronization sensor 32, a horizontal synchronizing signal Hsync from the horizontal synchronization sensor 56, and detect signals from the position sensor 25 and the transfer paper sensor 90. Based on these input signals and the control program, the CPU 111 controls operations of the respective portions of the engine part 1.

In short, the CPU 111 sends a control signal to a motor drive circuit 114 which drives the photosensitive member driving motor 36, synchronizes the photosensitive member 11 and the intermediate transfer belt 31 to each other, and drives these. Further, the CPU 111 sends a control signal to a contacting/clearing clutch drive circuit (not shown) which drives the respective contacting/clearing clutches, and controls clearing of the belt cleaner 33 and the secondary transfer roller 35 off from the intermediate transfer belt 31 and abutting of the belt cleaner 33 and the secondary transfer roller 35 on the intermediate transfer belt 31. The CPU 111 accepts operations made through the operation keys of the operation display panel 8, and controls a displayed content of the display part.

The CPU 111 is for sending the control signal to a motor drive circuit 115 which drives the transportation system driving motor 84 and for controlling transportation of the transfer paper 4 from the paper feeding cassette 3 to the discharging part 6, and ensures that the transfer paper 4 is transported at the same speed as the circumferential speed of the intermediate transfer belt 31. Further, the CPU 111 sends the control signal to a clutch drive circuit 116 which drives the paper feed clutch 85, and controls feeding of the transfer paper 4 from the paper feeding cassette 3 onto the transfer paper transportation path 7. In addition, the CPU 111 sends the control signal to a clutch drive circuit 117 which drives the gate clutch 86, and in synchronization to the primarily transferred toner image on the intermediate transfer belt 31, causes secondary feeding of the transfer paper 4 from the paired gate rollers 63 to the secondary transfer part 37.

Further, the CPU 111 sends the control signal to a developing bias generating circuit 118 and controls application of the developing bias. Further, the CPU 111 sends the control signal to a motor drive circuit 119 which drives a connector drive motor 28, and controls engagement of the main-side connector 27 to the unit-side connectors 26Y, 26C, 26M and 26K and disengagement of the main-side connector 27 from the unit-side connectors 26Y, 26C, 26M and 26K. Using the control signal sent to the laser light source 51, the CPU 111 counts the number of write pixels for writing an electrostatic latent image, calculates the amounts of used toner in the respective colors based on the number of the pixels, writes data regarding the amounts of used toner in the non-volatile memories 83Y, 83C, 83M and 83K and reads out contents stored in the non-volatile memories 83Y, 83C, 83M and 83K, thereby detecting whether the mounted developer units 2Y, 2C, 2M and 2K are new, judging the remaining lifetime, etc.

Further, the CPU 111 sends the control signal to a motor drive circuit 120 which drives the developing system drive motor 81, sends the control signal to a clutch drive circuit 121 which drives the rotary clutch 82, and accordingly controls rotations of the holder frame 22 and the developer rollers 23Y, 23C, 23M and 23K.

When printing is not ongoing, the CPU 111 positions the holder frame 22 at the stand-by position. As a color print instruction signal for printing on more than one paper is supplied to the CPU 111 via the CPU 101 of the main controller 100 from an external apparatus, the CPU 111 causes the holder frame 22 at the stand-by position to rotate and position each developer unit to the developing position in the order of 2Y, 2C, 2M and 2K, whereby a color toner image is formed. In short, the holder frame 22 is rotated from the stand-by position as the rotary clutch 82 is turned on and the developing system drive motor 81 drives for forward rotations, thereby positioning the developer unit 2Y to the developing position. The rotary clutch 82 is then turned off, the developing system drive motor 81 drives for backward rotations, and the developer roller 23Y rotates. As the development by the developer unit 2Y ends, deceleration of the developer roller 23Y is started. After the deceleration ends, the rotary clutch 82 is turned on and the developing system drive motor 81 drives for forward rotations, whereby the holder frame 22 rotates and the developer unit 2C is positioned to the developing position. Thus, development in each color is performed in sequence. As the development by the developer unit 2K ends, deceleration of the developer roller 23K is started, and the holder frame 22 is rotated after the deceleration ends.

At this stage, in synchronization to the deceleration of the developer roller 23K, the detect signal from the transfer paper sensor 90 is accepted and whether there is a transfer paper 4 within the paper feeding cassette 3 is judged. When it is judged that there is a transfer paper 4, the holder frame 22 rotates and the developer unit 2Y is accordingly positioned to the developing position, following which the exposing operation in response to the next video signal is started. In synchronization to formation of a primarily transferred toner image on the intermediate transfer belt 31, the paper feed clutch 85 is turned on at predetermined timing and feeding of the transfer paper 4 from the paper feeding cassette 3 is started.

On the contrary, when it is judged that there is not a transfer paper 4, the holder frame 22 rotates and is positioned at the stand-by position, and without performing the exposing operation, a signal indicative of the absence of a transfer paper is sent out to an external apparatus via the CPU 100.

The CPU 111 corresponds to paper feeding control means, drive control means and transfer paper detecting means, the developer unit 2Y corresponds to the first developer unit, and the developer unit 2K corresponds to the last developer unit. Non-volatile memories such as an EEPROM, or other memories may be used as the ROM 112 and the RAM 113.

Figure 5:
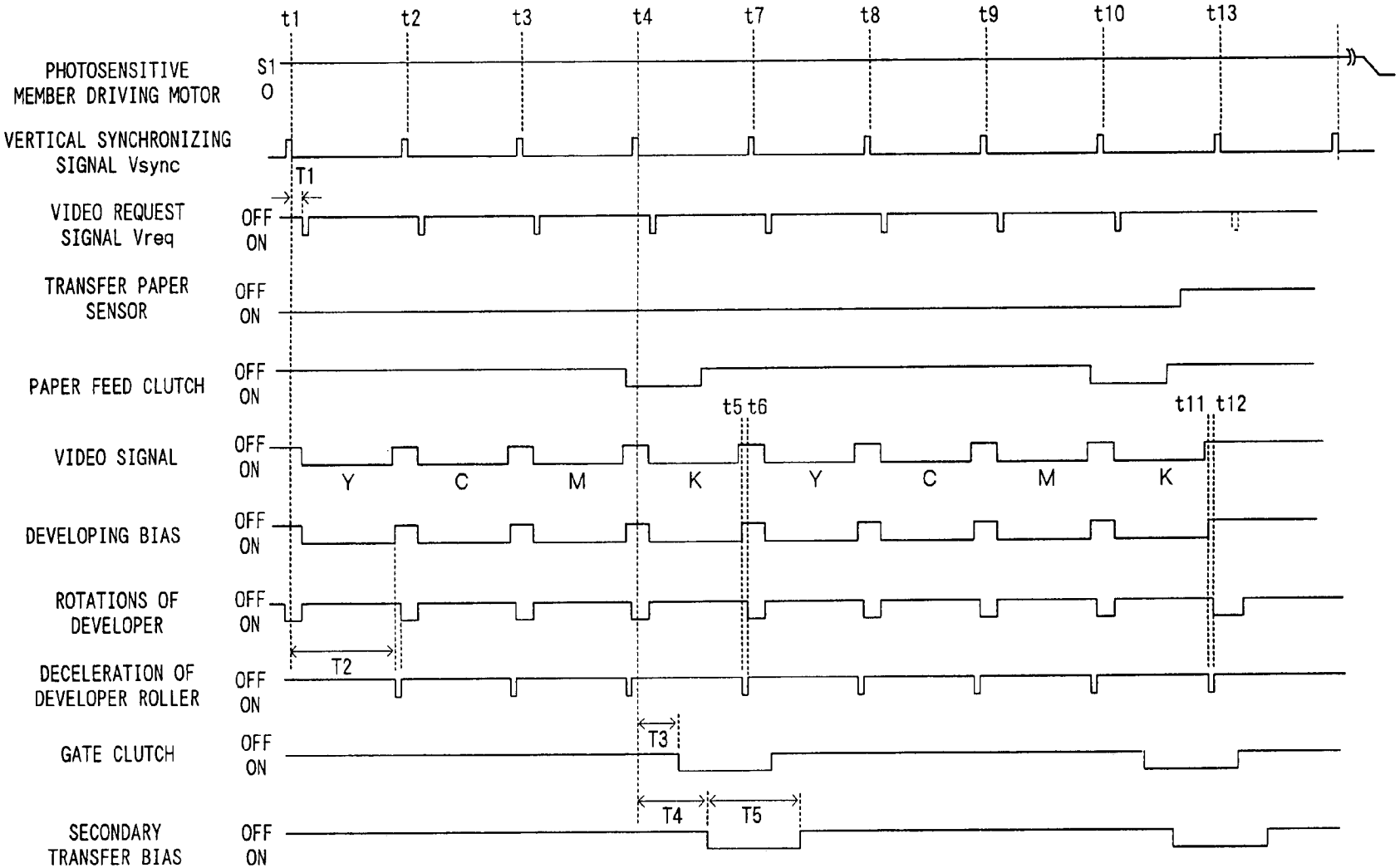
FIG. 5 is a timing chart which shows changes with time found in the states of the respective portions of the engine part.

Operations of this printer will now be described with reference to FIG. 5. FIG. 5 is a timing chart which shows changes with time found in the states of the respective portions of the engine part 1.

When the main controller 100 is fed with a print instruction signal containing a video signal from an external apparatus such as a host computer, the engine controller 110 causes the respective portions of the engine part 1 to start operating in accordance with the control signal from the main controller 100. With respect to the preferred embodiment, it is assumed that a print instruction signal which demands to print three color images is fed and there are only two transfer papers 4 housed in the paper feeding cassette 3.

In the event that the size of the transfer papers 4 housed in the paper feeding cassette 3 does not match with the size which is designated by the print instruction signal, the operation display panel 8 displays a message which asks for replacement of the paper feeding cassette. Although FIG. 1 shows the printer which comprises one paper feeding cassette 3, this is not limiting. Instead, the printer may comprise a plurality of paper feeding cassettes.

When the size of the transfer papers 4 housed in the paper feeding cassette 3 matches with the size which is designated by the print instruction signal (or when a plurality of paper feeding cassettes include a cassette which holds transfer papers 4 of the size designated by the print instruction signal), the transportation system driving motor 84 first turns on. Following this, as the transportation system driving motor 84 outputs a ready signal, driving of the photosensitive member driving motor 36 is started, whereby the intermediate transfer belt 31 is driven at a predetermined circumferential speed S1, the vertical synchronizing signal Vsync is outputted cyclically, and driving of the polygon motor 53 is started. As the polygon motor 53 outputs a ready signal, the vertical synchronizing signal Vsync is effectively accepted the next time and afterward, and the electrifier 12 uniformly electrifies the surface of the photosensitive member 11. By means of the laser light 57 from the exposure unit 50, an electrostatic latent image corresponding to the video signal described above is formed on the surface of the photosensitive member 11. As the rotary developer 20 develops the electrostatic latent image, a toner image is formed. The toner image is primarily transferred onto the intermediate transfer belt 31 within the primary transfer part 14.

In short, as shown in FIG. 5, the vertical synchronizing signal Vsync is outputted each at the time t1, t2, t3 and t4. After a predetermined period T1 from the respective falling edges of the vertical synchronizing signal Vsync, a video request signal Vreq is outputted. In synchronization to falling of this video request signal Vreq, formation of an electrostatic latent image corresponding to the video signal is started, concurrently with which the developing bias is turned on. By this time, the rotary developer 20 (the holder frame 22) has rotated from the stand-by position, thereby positioning the developer unit 2Y to the developing position.

The developer units of the rotary developer 20 switch over with each other at the time t1, t2, t3 and t4, whereby toner images in the respective colors are formed on the photosensitive member 11 and primarily transferred one after another onto the intermediate transfer belt 31. During this, since the secondary transfer roller 35 is away from the intermediate transfer belt 31, the toner images in the respective colors are superimposed one atop the other on the intermediate transfer belt 31.

The developing bias is turned off after a predetermined period T2, which is determined in advance in accordance with the size of the transfer papers, from the respective falling edges of the vertical synchronizing signal Vsync at the time t1, t2, t3 and t4. In synchronization to the turning off, deceleration of the developer rollers 23Y, 23C, 23M and 23K is started. In synchronization to the end of the deceleration, the rotary developer 20 starts rotating, which positions the next developer unit to the developing position. As a result, toner images Y, C, M and K are superimposed one atop the other in the transfer area 76 of the intermediate transfer belt 31.

On the other hand, the paper feed roller 61 takes out the top-most transfer paper 4 of the bundle of transfer papers which is housed in the paper feeding cassette 3, the paired feed rollers 62 transport the transfer paper 4 at a predetermined speed, the front edge of the transfer paper 4 arrives at the paired gate rollers 63, and the paired feed rollers 62 stop after a predetermined period. This makes the transfer paper 4 held in a bent state as shown in FIG. 1, and because of the bending force, the front edge of the transfer paper 4 is securely nipped between the paired gate rollers 63 entirely along the width direction. After a predetermined period T3 from the time t4 and in synchronization to the toner image on the intermediate transfer belt 31, the gate clutch 86 turns on and the transfer paper 4 is secondarily fed toward the secondary transfer part 37 from the paired gate rollers 63.

After a predetermined period from the time t4 at which the vertical synchronizing signal Vsync falls, the contacting/clearing clutch for secondary transfer roller turns on and the secondary transfer roller 35 abuts on the intermediate transfer belt 31. Following this, after a predetermined period T4 from the time t4, application of the secondary transfer bias upon the secondary transfer roller 35 is turned on. This transfers, onto the transfer paper 4, a color toner image which is obtained as the toner images Y, C, M and K primarily transferred onto the transfer area 76 of the intermediate transfer belt 31 are superimposed one atop the other.

The gate clutch 86 turns off after unloading of the transfer paper 4, and the secondary transfer bias is turned off after an application time T5 which is determined in advance in accordance with the size of the transfer papers 4. After the secondary transfer bias is turned off, the contacting/clearing clutch for secondary transfer roller turns on and the secondary transfer roller 35 moves cleared off the intermediate transfer belt 31. In the fixing unit 40, the toner image is fixed on the transfer papers 4 while the transfer papers 4 is transported. The paired transportation rollers 64 further transport the transfer papers 4, and the paired discharge rollers 65 discharge the transfer papers 4 into the discharging part 6.

Then, at the time t5, which is the end of the development which started at the time t4 executed by the developer unit 2K and which is the start of deceleration of the developer roller 23K (i.e., the time at which the developing bias is turned off), the detect signal from the transfer paper sensor 90 is accepted and whether there is a transfer paper 4 within the paper feeding cassette 3 is judged. Since it is judged that there is a transfer paper in FIG. 5, the rotary developer 20 rotates at the time t6, whereby the developer unit 2Y is positioned to the developing position.

Following this, a similar operation is performed in synchronization to the vertical synchronizing signal Vsync at the time t7, t8, t9 and t10, and the second image is transferred onto the transfer paper 4. Since the paper feeding cassette 3 becomes empty after the paper feed clutch 85 turns on and the second transfer paper 4 is fed, the transfer paper sensor 90 switches over from ON to OFF.

Hence, at the time t11, which is the end of the development which started at the time t10 executed by the developer unit 2K and which is the start of deceleration of the developer roller 23K (i.e., the time at which the developing bias is turned off), the detect signal from the transfer paper sensor 90 is accepted and whether there is a transfer paper 4 within the paper feeding cassette 3 is judged. Since it is judged that there is not a transfer paper in FIG. 5, the rotary developer 20 rotates at the time t12, whereby the rotary developer 20 (the holder frame 22) is positioned to the stand-by position. Meanwhile, a signal indicating that there is not a transfer paper is sent out to an external apparatus via the CPU 101, the printing operation stops. The video request signal Vreq is not outputted after the predetermined period T1 from the next vertical synchronizing signal Vsync at the time t13. The photosensitive member driving motor 36 decelerates after a predetermined period and stops, and standing by for the supply of the transfer paper 4.

As described above, according to this embodiment, since feeding of the transfer paper 4 by the paper feed roller 61 is started after exposing of the photosensitive member 11 by the exposure unit 50 is started, it is possible to shorten the time that the paired gate rollers 63 hold the transfer paper 4 in a bent state and prevent deformation of the transfer paper 4 from degrading the quality of a transfer image. Particularly, since the transfer paper 4 is transported along the transfer paper transportation path 7 which runs approximately in the vertical direction, the bent part of the transfer paper 4 can be easily deformed under its own weight. Therefore, in an image forming apparatus which is structured to have a transfer paper transportation path which runs approximately in the vertical direction, feeding of the transfer paper 4 from the paper feeding cassette 3 at the timing describe above makes it very effective in preventing the deformation of the transfer paper.

Further, according to this embodiment, since the detect signal from the transfer paper sensor 90 is accepted in synchronization to the start of the deceleration of the developer roller 23K of the developer unit 2K (the last developer unit), it is possible to judge whether there is a transfer paper 4 always at the same timing regardless of the size of the transfer papers 4, and hence, simplify the structure of the control program.

Further, in a condition that the developer unit 2K is positioned to the developing position, the rotary developer 20 (the holder frame 22) rotates to position the developer unit 2Y to the developing position when it is judged that there is a transfer paper, whereas the rotary developer 20 (the holder frame 22) rotates and positions itself to the stand-by position when it is judged that there is not a transfer paper. In short, movements of the rotary developer 20 are efficiently controlled by accepting the detect signal from the transfer paper sensor 90 in synchronization to the start of the deceleration of the developer roller 23K of the developer unit 2K (the last developer unit).

The present invention is not limited to the preferred embodiment described above but may be modified in various manners to the extent not deviating from the object of the invention. For example, although the timing chart in FIG. 5 described above represents an example that one image of the A3 size is formed as the intermediate transfer belt 31 rotates one round as shown in FIG. 3A, this is not limiting. Instead, as shown in FIG. 3B, two images of the A4, the B5 or other size for instance may be formed as the intermediate transfer belt 31 rotates one round. In such a case, too, as the detect signal from the transfer paper sensor 90 is accepted in synchronization to the start of the deceleration of the developer roller 23K, an effect similar to that promised by the preferred embodiment described above is obtained.

Further, although the preferred embodiment described above uses the intermediate transfer belt 31 comprising the splice 71 as an image carrier, this is not limiting. Instead, a seamless intermediate transfer belt, an intermediate transfer drum or the like may be used.

Further, while the foregoing has described the preferred embodiment above in relation to a printer which prints on a transfer paper an image fed from an external apparatus such as a host computer, the present invention is not limited to this. The present invention may be applied also to an electrophotographic image forming apparatus in a general use, such as a printer, a copier machine and a facsimile machine.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a photosensitive member;

exposure means which forms an electrostatic latent image on said photosensitive member;

developing means, including a plurality of developer units and a holder which holds said plurality of developer units and rotates about a predetermined rotation shaft, in which one of said plurality of developer units is selectively positioned facing said photosensitive member so that this developer unit makes toner adhering to said electrostatic latent image and accordingly develops said electrostatic latent image;

an intermediate transfer medium which transports a toner image primarily transferred from said photosensitive member to a predetermined secondary transfer position while carrying said primarily transferred toner image;

a transfer paper housing which is disposed below said secondary transfer position and house at least one transfer paper;

primary paper feeding means which is disposed over said transfer paper housing and at a start of a transfer paper transportation path which runs approximately in the vertical direction from said transfer paper housing to said secondary transfer position and guides a transportation of a transfer paper;

secondary paper feeding means which is disposed on said transfer paper transportation path and between said primary paper feeding means and said secondary transfer position; and paper feeding control means which controls an operation of said primary paper feeding means, wherein said primary paper feeding means picks up a transfer paper from said transfer paper housing and primarily feeds the transfer paper to said secondary paper feeding means along said transfer paper transportation path, said secondary paper feeding means secondarily feeds the transfer paper primarily fed by said primary paper feeding means toward said secondary transfer position along said transfer paper transportation path after temporarily holding the transfer paper in a bent state, and said paper feeding control means makes said primary paper feeding means start picking up the transfer paper after said exposure means starts said electrostatic latent image forming operation.

2. The image forming apparatus of claim 1, further comprising:

drive control means which controls rotations of said holder to thereby position said plurality of developer units to face said photosensitive member in a predetermined order starting with a first developer unit until a last developer unit;

transfer paper detecting means which detects whether the transfer paper is present or not within said transfer paper housing and outputs a detect signal which corresponds to the result of the detection; and transfer paper judging means which accepts said detect signal outputted from said transfer paper detecting means in synchronization to the end point of a developing operation performed by said last developer unit and which judges whether the transfer paper is present or not within said transfer paper housing.

3. The image forming apparatus of claim 2, wherein said drive control means positions said first developer unit so that said first developer unit faces said photosensitive member when transfer paper judging means decides that there is a transfer paper, but positions said holder to a predetermined stand-by position when said transfer paper judging means decides that the transfer paper is absent from said paper housing.

4. An image forming method for use in an image forming apparatus which comprises:

a photosensitive member;

exposure means which forms an electrostatic latent image on said photosensitive member;

developing means, including a plurality of developer units and a holder which holds said plurality of developer units and rotates about a predetermined rotation shaft, in which one of said plurality of developer units is selectively positioned facing said photosensitive member so that this developer unit makes toner adhering to said electrostatic latent image and accordingly develops said electrostatic latent image;

an intermediate transfer medium which transports a toner image primarily transferred from said photosensitive member to a predetermined secondary transfer position while carrying said primarily transferred toner image;

a transfer paper housing which is disposed below said secondary transfer position and house at least one transfer paper;

primary paper feeding means which is disposed over said transfer paper housing and at a start of a transfer paper transportation path which runs approximately in the vertical direction from said transfer paper housing to said secondary transfer position and guides a transportation of a transfer paper; and secondary paper feeding means which is disposed on said transfer paper transportation path and between said primary paper feeding means and said secondary transfer position, wherein said primary paper feeding means picks up a transfer paper from said transfer paper housing and primarily feeds the transfer paper to said secondary paper feeding means along said transfer paper transportation path, said secondary paper feeding means secondarily feeds the transfer paper primarily fed by said primary paper feeding means toward said secondary transfer position along said transfer paper transportation path after temporarily holding the transfer paper in a bent state, and wherein after said exposure means starts said electrostatic latent image forming operation, said primary paper feeding means starts picking up the transfer paper.

* * * * *